US005408726A

United States Patent [19]

Kent

[11] Patent Number: 5,408,726

[45] Date of Patent: Apr. 25, 1995

[54] LOCKING DEVICE FOR LOCKING A CLOSURE IN AN OPEN POSITION

[76] Inventor: Erma W. Kent, 201 Bass Rd., Macon, Ga. 31210-2034

[21] Appl. No.: 79,388

[22] Filed: Jun. 21, 1993

[51] Int. Cl.[6] ..... E05D 11/10

[52] U.S. Cl. ..... 16/326; 16/329; 16/330; 16/342; 16/320

[58] Field of Search ..... 16/326, 329, 330, 332, 16/325, 324, 328, 331, 349, 353

[56] References Cited

U.S. PATENT DOCUMENTS

| | | | |
|---|---|---|---|
| 294,746 | 3/1884 | Straup et al. | 16/330 |
| 769,035 | 8/1904 | Walter | 16/50 |
| 917,768 | 4/1909 | Jordan . | |
| 975,097 | 11/1910 | Wright | 16/330 |
| 1,060,641 | 5/1913 | Sladden . | |
| 1,125,265 | 1/1915 | Carter | 16/330 |
| 1,183,596 | 5/1916 | Sachse . | |
| 1,429,416 | 9/1922 | Fade | 16/330 |
| 1,440,713 | 1/1923 | Ausbourne | 16/330 |
| 1,465,912 | 8/1923 | Jensen | 16/330 |
| 1,489,679 | 4/1924 | Thornton . | |
| 1,946,837 | 2/1934 | Clayton | 16/330 |
| 2,097,651 | 11/1937 | Stangeland | 16/330 |
| 2,146,460 | 2/1939 | Beeler | 292/257 |
| 2,427,384 | 9/1947 | Bushko . | |
| 2,966,697 | 1/1961 | Mintz | 16/325 |
| 3,448,486 | 6/1969 | Wright | 16/324 |
| 3,559,232 | 2/1971 | Crane | 16/50 |
| 3,629,900 | 12/1971 | Beerli . | |
| 4,999,937 | 3/1991 | Bechtold | 16/329 |
| 5,125,131 | 6/1992 | Leblanc | 16/330 |

FOREIGN PATENT DOCUMENTS

| | | | |
|---|---|---|---|
| 456448 | 11/1928 | Germany | 16/329 |
| 541971 | 1/1932 | Germany | 16/353 |
| 812047 | 8/1951 | Germany | 16/330 |
| 552546 | 11/1957 | Italy | 16/329 |
| 232741 | 4/1925 | United Kingdom | 16/330 |

*Primary Examiner*—Lowell A. Larson
*Assistant Examiner*—Donald M. Gurley
*Attorney, Agent, or Firm*—Roylance, Abrams, Berdo & Goodman

[57] ABSTRACT

A locking device for pivotally interconnecting a closure to a support and locking the closure in an open position relative to the support. The interlocking device interconnects the closure and support about a vertical axis, so that the closure can pivot about this axis and open and close relative to the support. The interlocking mechanism includes a locking mechanism having two engageable locking ratchet members. One ratchet member is fixedly coupled to the closure, and the second ratchet member is coupled to the support for movement along the vertical axis. The locking mechanism also has a spring which biases the ratchet members together into engagement with each other. Both ratchet members have compatible teeth with a ramping surface and a stopping surface for limiting the pivotal movement of the closure to a first direction and locking the closure in an open position. The releasing mechanism disengages the ratchet members, which allows the closure to be closed. The releasing mechanism may be manually operated or electrically operated through the use of a solenoid. The engaging mechanism causes the ratchet members to reengage when the closure is closed.

31 Claims, 9 Drawing Sheets

LOCKING DEVICE FOR LOCKING A CLOSURE IN AN OPEN POSITION

FIELD OF THE INVENTION

This invention relates to a ratchet or wedge locking device for pivotally interconnecting a closure to a support and locking the closure in at least one open position relative to the support or frame member. More specifically, this invention relates to a ratchet locking device for use in connection with a hinge of a hinged closure which 1) permits the closure to pivot in one direction and locks the door in a plurality of open positions when the ratchet locking device is engaged and 2) permits the closure to pivot in the opposite direction when the ratchet locking device is disengaged.

BACKGROUND OF THE INVENTION

Presently, the Office of Vehicle Safety Standards is considering new regulations relating to emergency door exits for school buses. Generally, these regulations will require school buses to have emergency doors which, when opened, automatically lock in an open position regardless of the orientation of the bus. These regulations will help ensure that children can easily exit from school buses in the event of an emergency.

Specifically, these regulations will require that school bus emergency doors be equipped with a device that (1) locks the doors in an open position past the point at which the door is perpendicular to the bus body, regardless of the bus orientation; (2) bears the weight of the door; and (3) provides a mechanism for releasing the door from its locked position and thus, allows the door to close. Accordingly, there is obviously a need for a locking device that meets these standards.

Furthermore, in emergency situations, children may not be able to push a heavy emergency bus door over 90° at one time, especially if the bus is laying on its side, an obstruction prevents the door from opening that widely, or the bus is in water. Therefore, preferably, the locking device should lock the door open in several positions before locking the door in a final open position over 90° from the closed position. Therefore, there is a need for a closure locking device which will lock a closure in various open positions.

Examples of locking hinges which lock a door in an open position and prevent it form closing until being released are disclosed in U.S. Pat. Nos. 294,746 issued on Mar, 4, 1884 to Straup et al; 917,768 issued on Apr. 13, 1909 to Jordan; 1,060,641 issued on May 6, 1913 to Sladden; 1,183,596 issued on May 16, 1916 to Sachse; 1,489,679 issued on Apr. 8, 1924 to Thornton; 2,966,697 issued on May 16, 1958 to Mintz; 2,146,460 issued on Feb. 7, 1939 to Beeler; 3,559,232 issued on Mar. 21, 1969 to Crane; and 3,629,900 issued on Dec. 28, 1971 to Beerli, Jr.

However, these prior locking hinges have several disadvantages. Many of these locking hinges do not automatically lock the door in an open position. Furthermore, with respect to the application of these devices to school buses, each manufacturer of school buses, i.e., Blue Bird, Am Tran, Carpenter and Thomas, currently uses different hinges on the emergency doors. These hinges do not lock the door in an open position, and replacing these current hinges with the prior locking hinges is inefficient and expensive. Additionally, many of these hinges can only be used in connection with certain types of doors. Furthermore, these hinges do not always provide the support and strength needed in emergency situations in applications such as school buses. Finally, many of the prior locking hinges have complicated release mechanisms which have many parts and are hard to manufacture.

Examples of hinges which hold a door in an open position, but do not lock it in an open position are disclosed in U.S. Pat. Nos. 769,035 issued on Aug. 30, 1904 to Walter; 975,097 issued on Nov. 8, 1910 to Wright; 1,125,265 issued on Jan. 19, 1915 to Carter; 1,429,416 issued on Sep. 19, 1922 to Fade; 1,440,713 issued on Jan. 2, 1923 to Ausbourne; 1,465,912 issued on Aug. 21, 1923 to Jensen; 1,946,837 issued on Feb. 13, 1934 to Clayton; 2,097,651 issued on Nov. 2, 1927 to Stangeland; and 2,427,384 issued on Sep. 16, 1947 to Bushko.

In view of the above, it is apparent that a need exists for a locking device that automatically locks a door in several open positions, can be easily released from any of the locked open positions, can be retrofitted to current hinges and can be used in connection with any type of hinge and closure. This invention addresses these needs in the art, along with other needs which will become apparent to those skilled in the art once given this disclosure.

SUMMARY OF THE INVENTION

This invention provides a ratchet or wedge locking device for pivotally interconnecting a closure to a support and locking the closure in at least one open position relative to the support. The locking device includes a locking mechanism and a releasing device. The locking mechanism has a first wedge ratchet member fixedly coupled to the closure, a second wedge ratchet member coupled to the support, and a biasing mechanism or spring for biasing the first and second wedge ratchet members into engagement with each other. The first and second wedge ratchet members have compatible teeth having a first ramping surface and a second stopping surface for limiting the pivotal movement of the closure to a first direction and locking the closure in an open position. The releasing device disengages the first and second wedge ratchet members without further pivotal movement of either wedge ratchet member and thereby allows the closure to close.

In some embodiments of this invention, the locking device further includes a first support member and a second support member. The first support member is fixedly coupled to the closure for movement with the closure, and the second support member is fixedly coupled to the support. The locking mechanism interconnects the first member to the second member about an axis for pivoting the first member about the axis to open and close the closure relative to the support.

In other embodiments of this invention the releasing mechanism is operated manually through the use of a pivot pin movably coupled to the support or second member and the second wedge ratchet member. Upon exerting an upward vertical force on the pivot pin, the second wedge ratchet member is disengaged from the first wedge ratchet member and is maintained in the disengaged position by a second pin which rests on a shelf and allows the closure to be closed.

In other embodiments, the release mechanism is operated automatically through the use of a solenoid, which, when activated, disengages the second wedge ratchet member from the first wedge ratchet member and allows the closure to close.

In yet other embodiments, the release mechanism is operated manually through the use of a cam member which forces the pivot pin upwardly. This disengages the second wedge ratchet member from the first wedge ratchet member and allows the closure to close.

In further embodiments, the locking device includes an engaging mechanism which causes the first and second wedge ratchet members to re-engage when the closure reaches the closed position.

In yet further embodiments, the first support member is coupled to a first leaf of a hinge and the second support member is coupled to a second leaf of a hinge.

The locking devices according to this invention have many advantages over prior locking devices.

One advantage of the locking devices according to this invention is that the devices automatically lock the closure in several open positions. Specifically, the first and second wedge ratchet members, which lock the closure in an open position when they are in engagement, are automatically biased into engagement by a spring.

Another advantage of the locking devices according to this invention is that the devices are easily releasable, either manually or automatically.

A further advantage of the locking devices according to this invention is that they may be retro-fitted for use in connection with any type of hinge, which is less expensive than replacing existing hinges.

Yet another advantage of the locking devices according to this invention is that they provide support and strength to existing closures and hinges, which may be necessary in emergency situations.

Still another advantage of the locking devices according to this invention is that the devices have relatively few parts and thus, are easy to manufacture and assemble.

Other advantages and salient features of the locking devices according to this invention will become apparent from the disclosure. Several embodiments of this invention will be described with respect to the drawings.

BRIEF DESCRIPTION OF THE DRAWINGS

Referring to the drawings which form a part of this disclosure.

DETAILED DESCRIPTION OF THE INVENTION

Referring to the Figures, and in particular FIGS. 1–5, a ratchet or wedge locking device, locking device 10, for locking a closure in at least one open position relative to a support according to this invention is illustrated.

Figure 2:
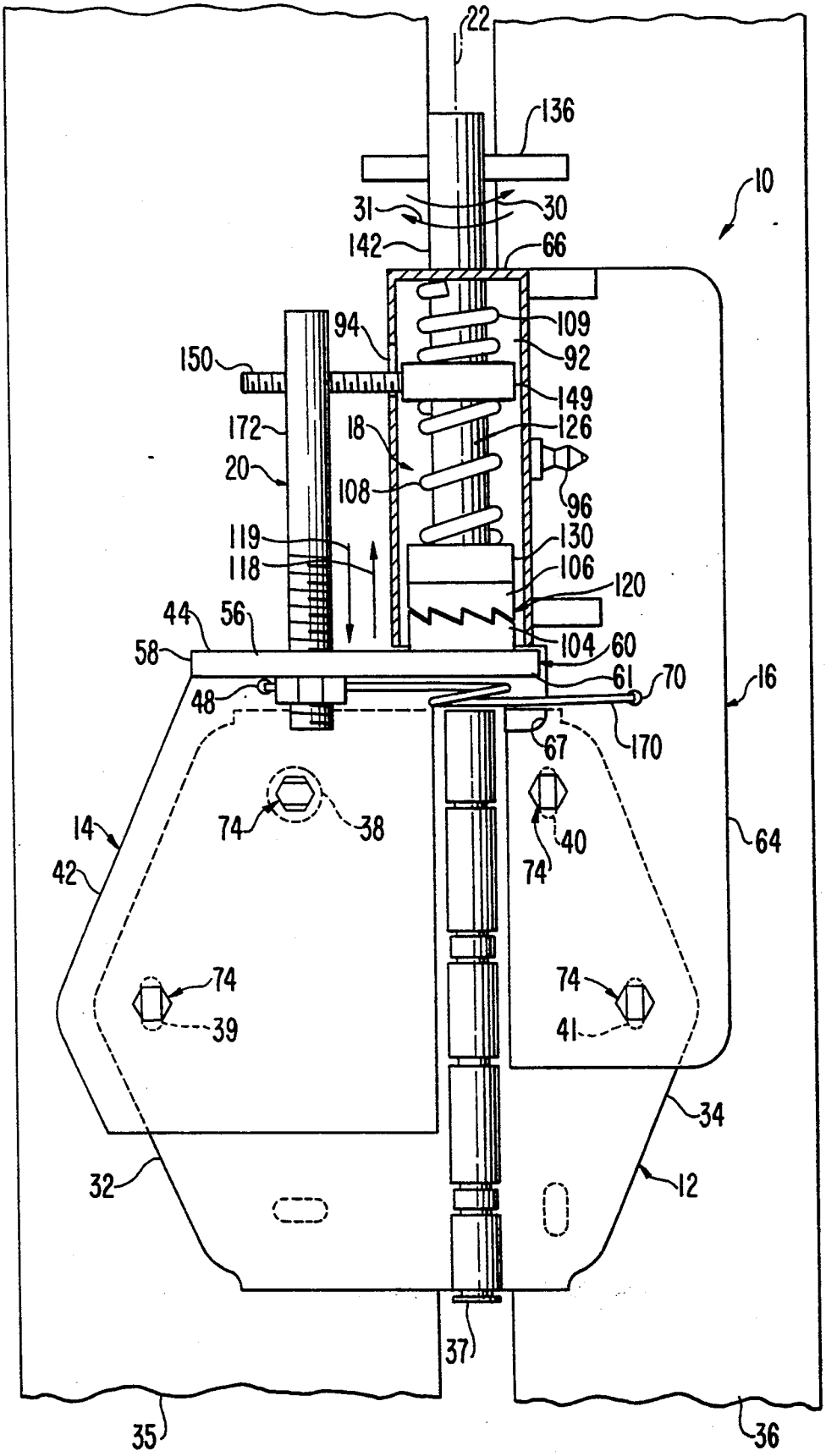
FIG. 2 is a front elevational view of the locking device illustrated in FIG. 1 coupled to a hinge, having the housing broken away for clarity and showing the wedge ratchet members engaged.

Locking device 10 may be used in almost any environment including a door or any other type of hinged closure such as a window. A typical environment is illustrated in FIG. 2, and includes hinge 12 attached to door 35 and door support or frame 36. Typically, hinge 12 includes first hinge leaf 32, second hinge leaf 34, and hinge pintle 37. First hinge leaf 32 has holes 38 and 39 therein and is fixedly coupled to door 35, and second hinge leaf 34 has holes 40 and 41 therein and is fixedly coupled to door support or frame 36. Pintle 37 pivotally interconnects first and second leaves 32 and 34 along vertical axis 22 and thereby allows door 35 to pivot in either pivotal direction 30 and 31 relative to the door support 36. Locking device 10 may be added to hinge 12 by lengthening hinge pintle 37 and coupling first and second leaves 32 and 34 with first and second supports 14 and 16 (discussed below).

Locking device 10 includes first support member 14, second support member 16, interlocking mechanism 18 and engaging mechanism 20 (see FIG. 2). Preferably, locking device 10 is formed of metal but alternatively may be made of any material that meets the strength requirements and pivots about the same axis as hinge 12, vertical axis 22, between a first closed position 24 and four open positions 26–29 in first and second pivotal directions 30 and 31 (see FIGS. 2 and 5). As discussed, locking device 10 may be retro-fitted onto any type of existing hinge 12 so that first and second supports 14 and 16 can provide additional support to an existing door and hinge, which may be needed in emergency situations.

First support member 14 includes base plate 42 and flange 44 and has a substantial thickness. First support 14 is fixedly and rigidly coupled to first leaf 32 adjacent pintle 37 via fastening assemblies 74.

Base plate 42 has three holes 46–48 therein and is shaped to conform to first hinge leaf 32. Holes 46–48 extend through base plate 42 (see FIG. 1).

Flange 44 includes top surface 56, first end 58, second end 60 and two holes 62 and 63. Flange 44 is rigid and immovable, is fixedly and rigidly coupled to base plate 42, extends perpendicularly and outwardly from base plate 42 and may be integrally formed with base plate 42. Second end 60 extends over and is spaced from hinge pintle 37, is rounded and forms a stop surface 61 which limits the extent of pivotal movement in the first pivotal direction 30 of first member 14 (see FIG. 5). Hole 62 is adjacent first end 58, and hole 63 is adjacent second end 60 and aligned with vertical axis 22 and hinge pintle 37.

Second support 16 includes base plate 64 and housing 66 and has a substantial thickness, approximately equal to the thickness of first support member 14. Second support member 16 is fixedly and rigidly coupled to second hinge leaf 34 via fastening assemblies 74 (see FIG. 2).

Base plate 64 includes recessed portion 67 and three holes 68–70 and is shaped to conform to second hinge leaf 34. Second end 60 of flange 44 of first support 14 extends into recessed portion 67. Holes 68–70 extend through base plate 64.

Figure 1:
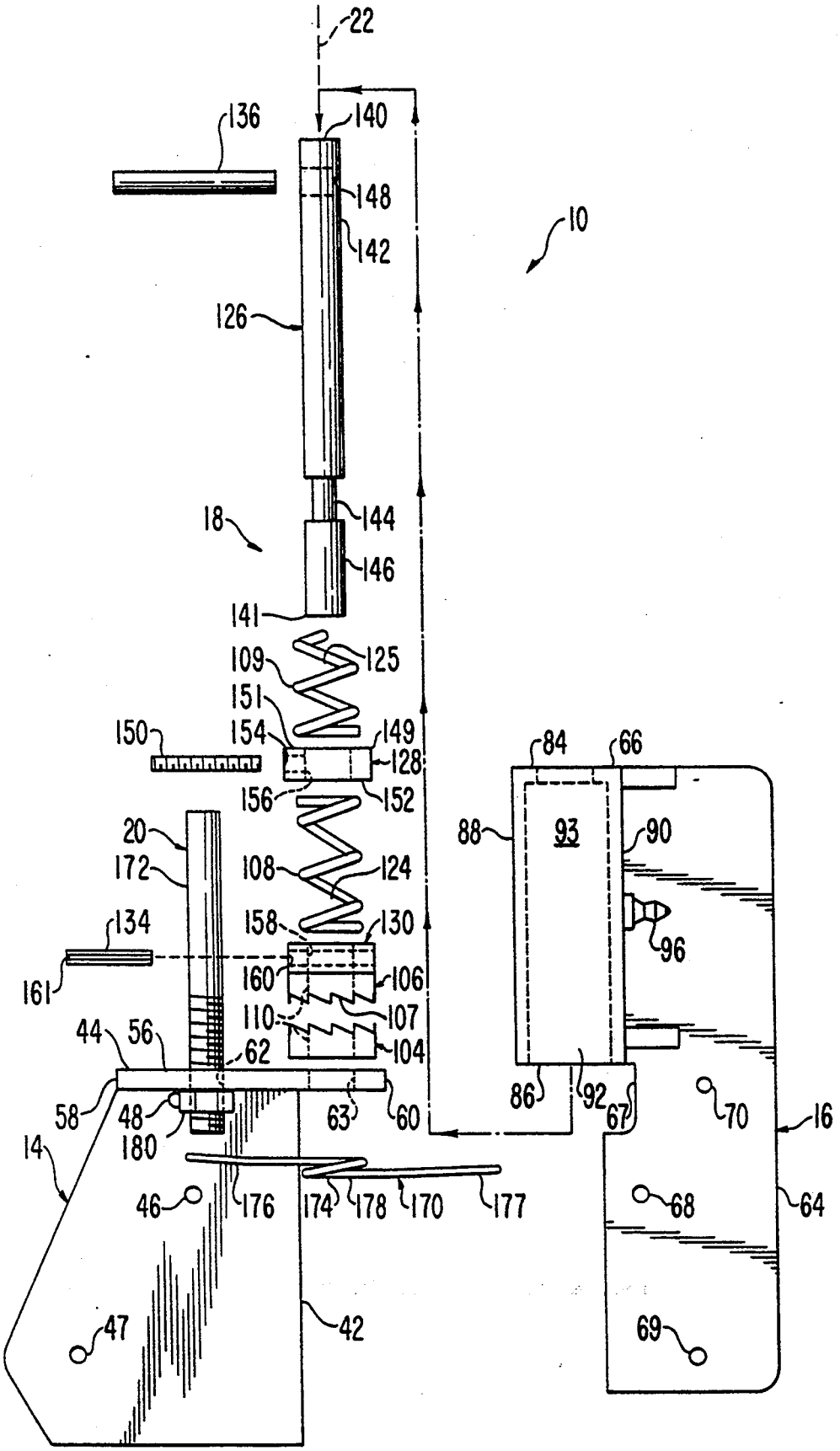
FIG. 1 is an exploded view of a first embodiment of a ratchet or wedge locking device in accordance with the present invention.
Figure 3:
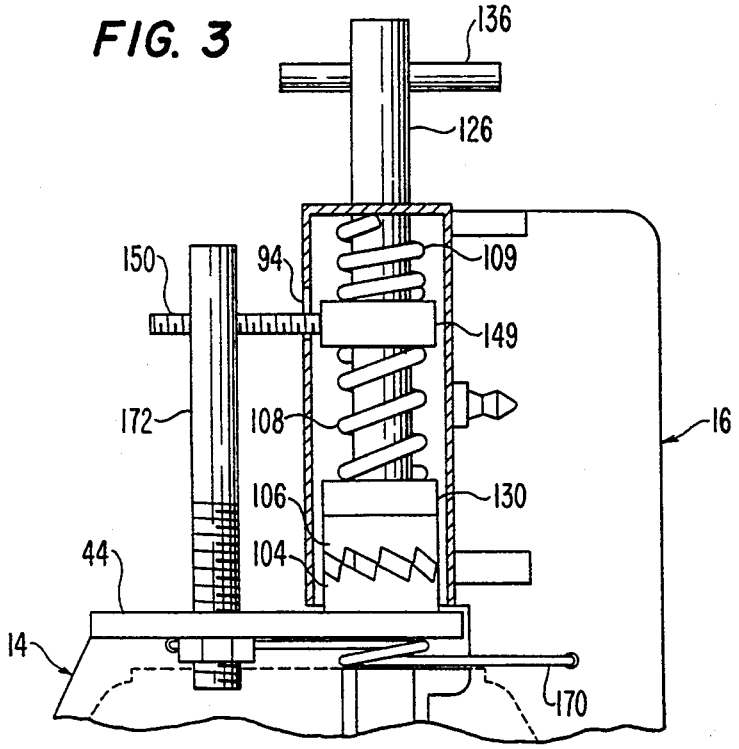
FIG. 3 is a partial front elevational view of the locking device illustrated in FIGS. 1 and 2, showing the movement of the second wedge ratchet member as the locking device is pivoted open.
Figure 6:
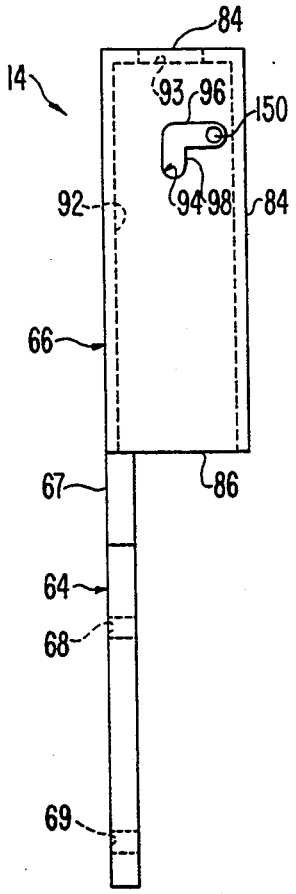
FIG. 6 is a side elevational view of the second support of the locking device illustrated in FIGS. 1–5, showing the L-shaped aperture.

Housing 66 includes first end 84, second end 86, first side 88, second side 90, passageway 92 and hole 93 (see FIGS. 1 and 6). As shown in FIGS. 1–3, housing 66 is fixedly and rigidly coupled to base plate 64 above recessed portion 67 by welding. Alternatively, housing 66 may be integrally formed with base plate 64. Housing 66 forms a hollow rectangular cylinder and encases a substantial portion of interlocking mechanism 18 (described below). First end 84 is partially closed with circular hole 93 extending through the center of first end 84 centered around axis 22. Second end 86 is completely open and adjacent and slightly spaced from second end 60 of flange 44. First side 88, as seen in FIG. 6, has L-shaped aperture 94 extending through it. L-shaped aperture 94 has first top leg 96 which functions as a shelf and second leg 98. Second side 90 has a grease fitting 96 fixedly coupled thereto (see FIG. 1). Passageway 92 has a rectangular cross-section, extends along the vertical axis 22 and is aligned with hole 63 in flange 44 of first support member 14 and hinge pintle 36.

Fastening assemblies 74 include bolts 50 and nuts 51, and may include washers 52. When assembled, holes 46 and 47 of first support 14 align with holes 38 and 39 of first leaf 32, respectively, and holes 68 and 69 of second support 16 align with holes 40 and 41 of second leaf 34, respectively, so that fastening assemblies 74 couple base plates 42 and 64 to leaves 32 and 34, respectively, in a conventional manner, as shown in FIG. 2.

Interlocking mechanism 18 pivotally connects first and second supports 14 and 16 about vertical axis 22 such that first support 14 can pivot about vertical axis 22 and open or close door 35 relative to door support 36. Interlocking mechanism 18 also variably locks first support member 14 in position 26–29, thereby locking door 35 in the same positions (see FIG. 5). Interlocking mechanism 18 includes first and second wedge ratchet members 104 and 106, biasing mechanism or spring 108, spring 109, pivot pin 126, pin assembly 128, first collar 130, coupling pin 134 and handle 136.

Pivot pin 126 includes first end 140 and second end 141, and in seriatim beginning at first end 140, first cylindrical portion 142, second reduced cylindrical portion 144, and third cylindrical portion 146 (see FIG. 1). Pivot pin 126 extends along vertical axis 22 and moves upwardly along vertical axis 22 in the upward vertical direction 118 to disengage wedge ratchet members 104 and 106 and moves downwardly along vertical axis 22 in the downward vertical direction 119 to engage wedge ratchet members 104 and 106.

First cylindrical portion 142 has bore 148 extending through it perpendicularly to the vertical axis 22 and adjacent the first end 140 of pivot pin 126. First and third cylindrical portions 142 and 146 have equal cross-sectional diameters. Second reduced cylindrical portion 144 is between the first and third portions 142 and 146 and has a cross-sectional diameter smaller than the cross-sectional diameters of the first and third portions 142 and 146.

As best seen in FIGS. 7–10, wedge ratchet members 104 and 106 each include ten (10) teeth 107. Wedge ratchet members 104 and 106 are cylindrical disks or gears having uniform ratchet or wedge teeth 107 extending from one end of the disk around the periphery. Wedge ratchet members 104 and 106 each include bores 110, and all of the teeth 107 include stop surfaces 112, flat surfaces 114 and ramp surfaces 116. Bores 110 extend completely through the center of wedge ratchet members 104 and 106.

Figure 5:
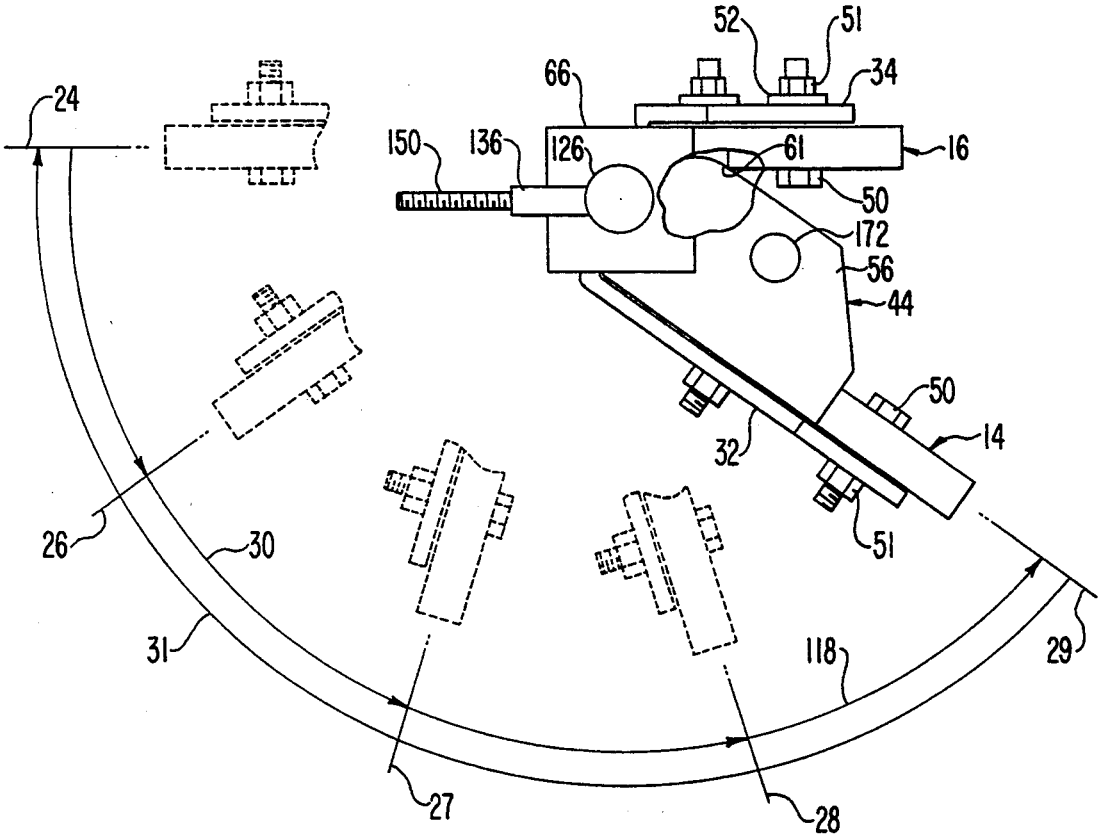
FIG. 5 is a top plan view of the locking device illustrated in FIGS. 1–4, pivoted to its fourth open position and showing the other three open positions and the closed position and partially broken away to show the stop surface limiting the locking device's pivotal movement.

Stop surfaces 112 extend parallel to axis 22 and limit pivotal movement of the first support 14 to the first pivotal direction 30 when wedge ratchet members 104 and 106 are in engagement, as shown in FIG. 5 and as described below. Flat surfaces 114 are formed at the tips of teeth 107 and extend perpendicularly to axis 22. Teeth 107 are flattened to prevent wear and breakage that would occur when teeth 107 are engaged if teeth 107 had pointed ends. Ramp surfaces 116 extend angularly between stop surfaces 112 and flat surfaces 114 and allow first support 14 to pivot in the first pivotal direction 30.

Wedge ratchet member 104 is rigidly and fixedly coupled to first support 14. Specifically, wedge ratchet member 104 is coupled to the top surface 56 of flange 44 at the second end 60 thereof such that bore 110 of wedge ratchet member 104 is aligned with hole 63 of flange 44. Wedge ratchet member 104 extends upwardly from flange 44 and radially around axis 22. Thus, wedge ratchet member 104 pivots with first support member 14 in the first pivotal direction 30 as door 35 is opened and in the second pivotal direction 31 as door 35 is closed.

Wedge ratchet member 106 is coupled within housing 66 (as described below) such that bores 110 of wedge ratchet members 104 and 106 are aligned. Specifically, wedge ratchet member 106 extends radially around axis 22 facing wedge ratchet member 104 so that teeth 107 of wedge ratchet members 104 and 106 can engage each other, as in FIG. 2. Furthermore, wedge ratchet member 106 may be reciprocated along vertical axis 22 in first vertical direction 118 and second vertical direction 119 between a first engaged position 120 (see FIG. 2) and a second disengaged position 122 (see FIG. 4). The respective teeth 107 of wedge ratchet members 104 and 106 are disengaged when wedge ratchet member 106 is in the disengaged position 122, and are engaged when wedge ratchet member 106 is in the engaged position 120.

Spring 108 is preferably a coil spring having passageway 124. Spring 108 is positioned around pivot pin 126 within housing 66, and one end of spring 108 engages second wedge ratchet member 106 and the other end abuts collar 149, as described below. When spring 108 is compressed, it biases second wedge ratchet member 106 into engagement with first wedge ratchet member 104, as illustrated in FIG. 2.

Figure 7:
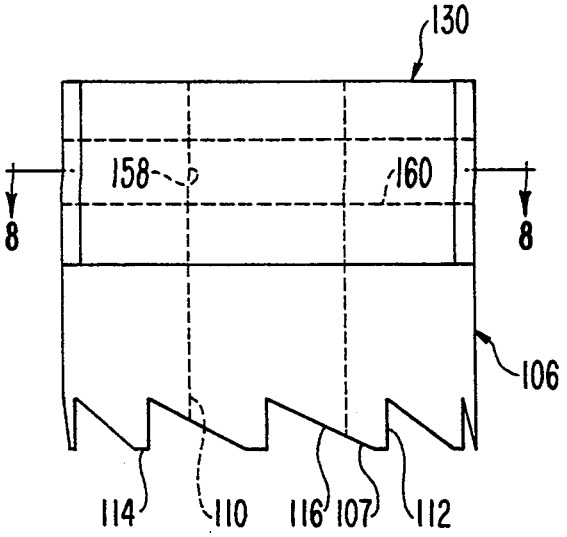
FIG. 7 is a side elevational view of the second wedge ratchet member and the collar attached to the second wedge ratchet member of the locking device illustrated in FIGS. 1–6.
Figure 8:
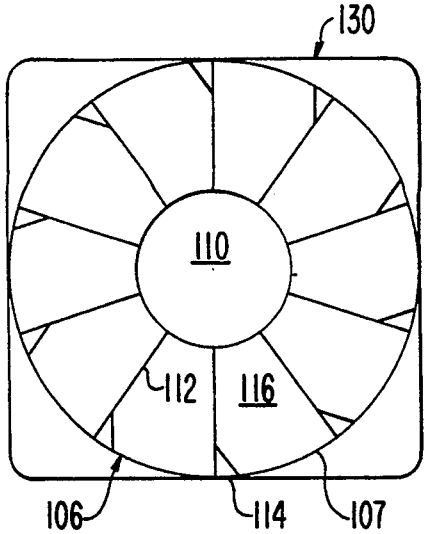
FIG. 8 is a bottom plan view of the collar and the second wedge ratchet member illustrated in FIG. 7.
Figure 9:
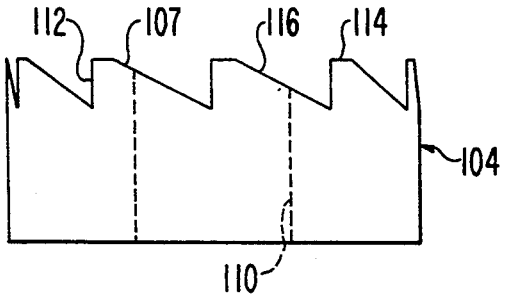
FIG. 9 is a side elevational view of the first wedge ratchet member of the locking device illustrated in FIGS. 1–8.
Figure 10:
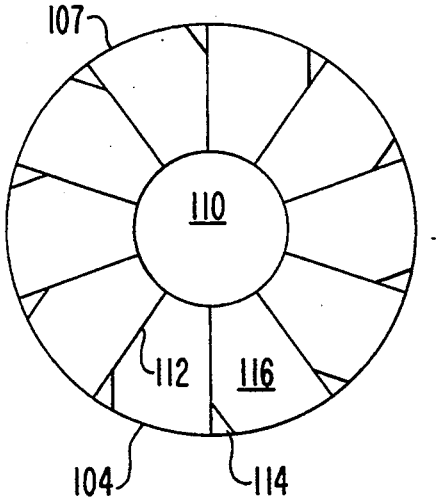
FIG. 10 is a top plan view of the first wedge ratchet member illustrated in FIG. 9.

Collar 130 has two passageways 158 and 160 and is integrally and unitarily coupled to second wedge ratchet member 106. Collar 130 is substantially rectangular with slightly curved corners, as illustrated in FIGS. 7 and 8. Its rectangular shape prevents wedge ratchet member 106 from pivoting within housing 66 since passageway 92 of housing 66 is also rectangular. Collar 130 is also movably coupled to reduced portion 144 of pivot pin 126, as described below.

Figure 8A:
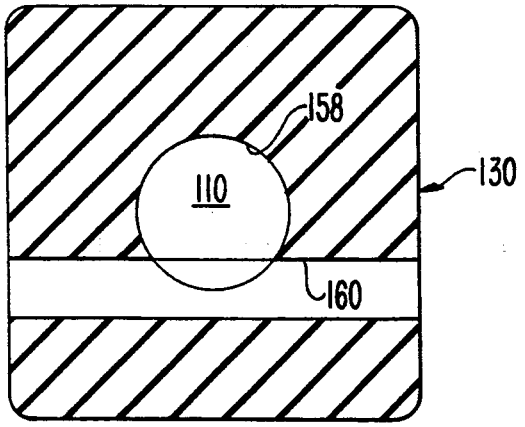
FIG. 8A is a longitudinal cross-sectional view, taken along line 8—8 in FIG. 7 of the collar illustrated in FIGS. 7–8.

Passageway 158 is cylindrical, extends through collar 130 along vertical axis 22 and has reduced portion 144 of pivot pin 126 extending through it. Passageway 160 is also cylindrical but extends perpendicularly to axis 22 through collar 130 and thus, a portion of passageway 160 intercepts a portion of passageway 158. Furthermore, passageway 160 does not extend through a diameter of collar 130 but is slightly off-set from a diameter of collar 130 (see FIG. 8A). Stated differently, passageway 160 is perpendicular to, but off-set from vertical axis 22.

Coupling pin 134 has a groove 161 extending lengthwise through it, making coupling pin 134 C-shaped (see FIG. 1). Coupling pin 134 has a diameter substantially equal to the diameter of passageway 160, but because coupling pin 134 is slightly compressible along groove 161, it is insertable into passageway 160. Coupling pin 134 is also resilient, so once it is inserted into passageway 160, it expands slightly and is fixedly coupled within passageway 160. Because passageway 160 is off-set from the center of collar 130, coupling pin 134 abuts reduced portion 144 of pivot pin 126 which allows collar 130 and wedge ratchet member 106 to move axially along pivot pin 126 in the first and second vertical directions 118 and 119 a distance substantially equal to the length of reduced portion 144.

Pin assembly 128 includes second collar 149 and threaded or pressed second pin 150. Pin assembly 128 variably maintains wedge ratchet member 106 in its disengaged position 122, thereby allowing first support 14 to pivot in direction 31.

Collar 149 includes first end 151, second end 152, threaded bore 154 and cylindrical bore 156. Collar 149 is rigidly and fixedly coupled to pivot pin 126 at first cylindrical portion 142 so that first cylindrical portion 142 extends through cylindrical bore 156. Cylindrical bore 156 extends completely through collar 149 and is centered around vertical axis 22. First end 151 engages one end of spring 109, and second end 152 engages one end of spring 108. Threaded bore 154 extends perpendicularly to vertical axis 22 through one wall of collar 149.

Threaded pin 150 is threadedly coupled with threaded bore 154 and extends outwardly from bore 154 through L-shaped aperture 94 of housing 66 perpendicularly to axis 22. When wedge ratchet members 104 and 106 are disengaged as in FIG. 4, threaded pin 150 rests on top leg 96 of L-shaped aperture 94 allowing first support member 14 to pivot to the closed position 24 (see FIG. 6).

Spring 109 is preferably coiled and has a passageway 125 through which first portion 142 of pivot pin 126 is received. Spring 109 is compressed or loaded with one end of spring 109 engaging the first end 84 of housing 66, and the other end of spring 109 engaging the first side 151 of collar 149. Spring 109 biases against collar 149 which moves pivot pin 126 in the downward vertical direction 119 causing wedge ratchet members 104 and 106 to engage each other.

Handle 136 is a smooth cylindrical bar and is fixedly and removably coupled to pivot pin 126 through bore 148. Handle 136 has substantial length such that the ends of handle 136 may project from each side of pivot pin 126. Lifting handle 136 in the first vertical direction 118 also lifts pivot pin 126 and disengages wedge ratchet members 104 and 106.

Engaging mechanism 20 includes third spring 170 and an engaging bolt 172. Engaging mechanism 20 causes first support 14 to pivot in the second pivotal direction 31 when wedge ratchet members 104 and 106 are in their disengaged position 122 and then causes wedge ratchet members 104 and 106 to re-engage when first support 14 reaches the closed position 24.

Torsion spring 170 has body 174 and two arms 176 and 177. Body 174 defines passageway 178. Second end 141 of pivot pin 126 extends into passageway 178. Arms 176 and 177 extend outwardly from body 174 perpendicularly to axis 22. First arm 176 couples spring 170 to the first support 14 via hole 48, and second arm 177 couples spring 170 to the second support 16 via hole 70 in a conventional manner.

Engaging bolt 172 extends upwardly through hole 62 of flange 44 and is fixedly coupled to flange 44 of first support member 14 by nut 180, which is fixed to flange 44. Bolt 172 has substantial length so that it engages threaded pin 150 when first support 14 is in the closed position 24, as in FIG. 2. Bolt 172 thus functions as a stop for first support 14.

ASSEMBLY AND OPERATION

Figure 4:
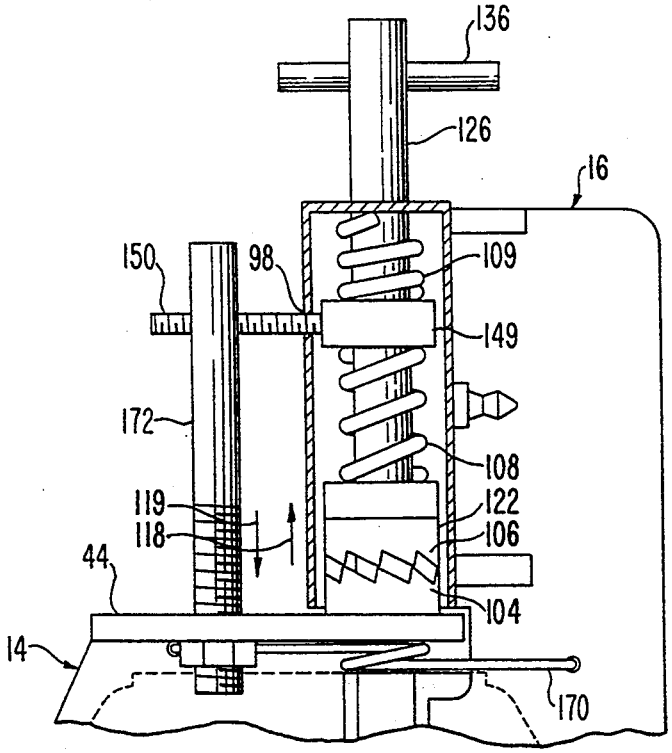
FIG. 4 is a partial front elevational view of the locking device illustrated in FIGS. 1–3, showing the wedge ratchet members disengaged.

In assembling locking device 10, as shown in FIGS. 2–4, wedge ratchet member 104 is fixedly coupled to top surface 56 of flange 44, preferably by welding. Hole 63 in flange 44 and bore 110 of wedge ratchet member 104 are aligned along vertical axis 22.

Next, collar 130 is fixedly and rigidly coupled to wedge ratchet member 106 such that bore 110 of wedge ratchet member 106 and passageway 158 of collar 130 are aligned. Collar 130 and wedge ratchet member 106 are then movably coupled to pivot pin 126 at its reduced portion 144 by inserting pivot pin 126 into passageway 158 and inserting coupling pin 134 into passageway 160 so that coupling pin 134 slidably abuts reduced portion 144 of pivot pin 126. Thus, collar 130 and wedge ratchet member 106 are movable along the vertical axis 22 at the reduced portion 144 for a distance substantially equal to the length of reduced portion 144 in the upward vertical direction 118 and the downward vertical direction 119, as previously discussed.

Spring 108 is then inserted over first end 140 of pivot pin 126, around pivot pin 126, so that one end of spring 108 engages first collar 130. Second collar 149 is fixedly coupled to first portion 142 of pivot pin 126 so that collar 149 engages the other end of spring 108 and compresses spring 108.

Second spring 109 is inserted over first end 140 of pivot pin 126, around pivot pin 126, such that one end of second spring 109 abuts top surface 151 of collar 149.

Second end 141 of pivot pin 126 is then inserted through bore 110 of wedge ratchet member 104 and hole 63 of flange 44 until wedge ratchet members 104 and 106 are in engagement. Second end 141 of pivot pin 126 extends slightly outwardly from hole 63. Housing 66, having passageway 92 therethrough, is inserted over pivot pin 126 with the second end 86 of housing 66 remaining slightly spaced apart from top surface 56 of flange 44 and the first end 140 of pivot pin 126 extending through hole 93 in the first end 84 of housing 66. Furthermore, L-shaped aperture 94 is aligned with threaded bore 154 of second collar 149, and spring 109 engages and is compressed by the first end 84 of housing 66. Springs 108 and 109 bias wedge ratchet member 104 and 106 together into their engaged position 120.

Handle 136 is then inserted through bore 148 in first cylindrical portion 142 of pivot pin 126, threaded pin 150 is inserted into threaded bore 154 of collar 149, engaging bolt 172 is inserted through hole 62 and coupled to flange 44 via nut 180 such that engaging bolt 172 engages threaded pin 150, and torsion spring 170 is coupled to pivot pin 126 and first and second supports 14 and 16 via holes 48 and 70.

Finally, first and second supports 14 and 16 are fixedly coupled to first and second hinge leaves 32 and 34 by fastening assemblies 74 as previously discussed.

In operation, first support 14, having wedge ratchet member 104 and engaging bolt 172 fixedly coupled thereto, pivots between the first closed position 24 and four open positions 26–29 in the first pivotal direction 30, as shown in FIG. 5. Each position 24 and 26–29 is spaced 36° apart from the next adjacent position. However, the space between each position and the number of positions varies upon the number of teeth 107 on wedge ratchet members 104 and 106. Thus, by changing the number of teeth 107, locking device 10 can pivot open to as many positions as may be necessary. Furthermore, locking device 10 can be activated and the door opened from inside the bus without having to extend hands outside the bus body.

In the closed position 24, wedge ratchet members 104 and 106 are in the first engaged position 120, as shown in FIG. 2. As door 35 is opened, first support 14 begins pivoting from the closed position 24 toward the first open position 26 in the first pivotal direction 30, and ramp surfaces 116 of first and second wedge ratchet members 104 and 106 slide relative each other. Because wedge ratchet member 104 is fixedly coupled to flange 44 and wedge ratchet member 106 is capable of axial movement in vertical directions 118 and 119 along pivot pin 126, the force exerted by ramp surfaces 116 of wedge ratchet member 104 on wedge ratchet member 106 biases second wedge ratchet member 106 in the upward vertical direction 118. Of course, collar 130 also moves upwardly in vertical direction 118 since it is integrally coupled to wedge ratchet member 106. Furthermore, spring 108 is biased upwardly or contracts in the upward vertical direction 118 since spring 108 rests on collar 130.

Just before first support 14 reaches first open position 26, flat surfaces 114 of wedge ratchet members 104 and 106 engage each other as in FIG. 3. As first support 14 reaches the first open position 26, spring 108 begins expanding and biasing second wedge ratchet member 106 axially in the downward vertical direction 119 until second wedge ratchet member 106 engages first wedge ratchet member 104. At this point, first support 14 is in the first open position 26. During this movement, pin 134 has moved along pivot pin 126 in reduced portion 144. Pivot pin 126 has remained stationary.

Locking device 10 operates in an identical manner as first support 14 pivots from first open position 26 to second open position 27, from second open position 27 to third open position 28, and from third open position 28 to fourth open position 29. When first support 14 reaches the fourth open position 29, stop surface 61 on second end 60 of flange 44 engages recessed portion 67 of second support 16 and limits any further pivotal movement of first support 14 in the first pivotal direction 30 (see FIG. 5). Locking device 10 can pivot to any open position up to 140° from its closed position 24, and the configuration of second end 60 or recessed portion 67 may be modified so as to allow the desired pivotal movement.

Once first support 14 has pivoted from closed position 24 to any open position 26–29, first support 14 is prohibited from pivoting in the second pivotal direction 31 by interlocking teeth 107 of wedge ratchet members 104 and 106. Stated differently, once door 35 has been opened to any open position 26–29, it cannot be closed without releasing the mechanism as discussed below. The stopping surfaces 112 of first and second wedge ratchet members 104 and 106 prohibit any pivotal movement in the second pivotal direction 31 unless wedge ratchet members 104 and 106 are in the second disengaged position 122, as in FIG. 3.

Wedge ratchet members 104 and 106 are disengaged from each other by lifting pivot pin 126 in the upward vertical direction 118, by lifting handle 136. As pivot pin 126 is forced upwardly along axis 22, second reduced cylindrical portion 146 engages pin 134 and raises collar 130 and second wedge ratchet member 106 until second wedge ratchet member 106 is completely disengaged from first wedge ratchet member 104.

Pivot pin 126 can only move upwardly a distance great enough to disengage second wedge ratchet member 106 from first wedge ratchet member 104 because further upward movement is limited by threaded pin 150 extending outwardly through L-shaped aperture 94 from within housing 66. Specifically, when wedge ratchet members 104 and 106 are in the first engaged position 120, threaded pin 150 rests within the second leg 98 of L-shaped aperture 94. Threaded pin 150 is fixedly coupled to collar 149, so as pivot pin 126 is pulled upwardly, threaded pin 150 simultaneously moves upwardly within second leg 98 of L-shaped aperture 94. Upon reaching first top leg of L-shaped aperture 94, threaded pin 150 restricts further upward movement of pivot pin 126.

Pivot pin 126 can then be slightly pivoted in the first pivotal direction 30 as threaded pin 150 simultaneously pivots within first top leg 96 of L-shaped aperture 94. Thereafter, pivot pin 126 can be released and threaded pin 150 will rest upon the shelf formed by top leg 96 of L-shaped aperture 94 (see FIG. 6), holding wedge ratchet member 106 out of engagement with wedge ratchet member 104. Thus, second wedge ratchet member 106 remains disengaged from first wedge ratchet member 104, and torsion spring 170 forces first support member 14 to pivot in the second pivotal direction 31 toward the closed position 24. Preferably, torsion spring 170 is adjusted so it does not force first support 14 completely to the closed position 24, and a final manual push against door 35 and thus, against first support 14 in the second pivotal direction 52, is necessary to force first support 14 into closed position 24.

Just before first support 14 reaches closed position 24, engaging bolt 172 engages threaded pin 150, which is resting in top leg 96 of L-shaped aperture 94. As first support 14 reaches the closed position, bolt 172 forces threaded pin 150 into the second leg 98 of L-shaped aperture 94. Second spring 109 then forces collar 149 and pivot pin 126 (since collar 149 is fixed to pivot pin 126) in the downward vertical direction 119. Threaded pin 150 moves downwardly within second leg 98. Because second wedge ratchet member 106 is coupled to pivot pin 126, it also moves in the downward vertical direction 119 and spring 108 forces wedge ratchet member 106 into first engaged position 120 with first wedge ratchet member 104.

SECOND EMBODIMENT OF FIG. 11

Figure 11:
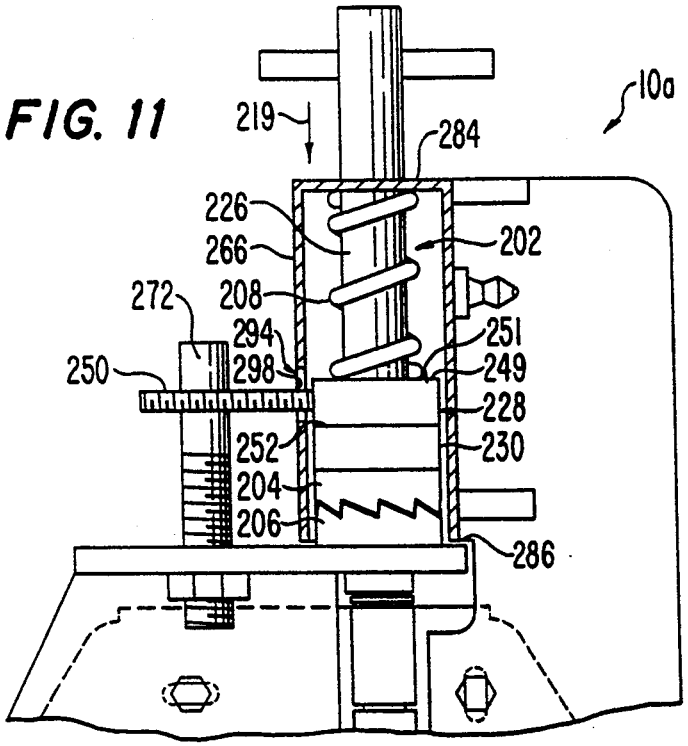
FIG. 11 is a partial front elevational view of a second embodiment of a locking device in accordance with this invention, having the housing broken away for clarity.

A second embodiment, locking device 10*a*, is illustrated in FIG. 11. This second embodiment is identical to the first embodiment in many respects and thus, only the differences from the first embodiment will be discussed.

Specifically, only pin assembly 228 and collar 230 differ slightly from pin assembly 128 and collar 130 of the first embodiment of locking device 10. Pin assembly 228 includes second collar 249 and threaded pin 250 identical to the first embodiment except that second side 252 of collar 249 is rotatably abuts collar 230.

Threaded pin 250 is threadedly coupled to collar 249 and extends outwardly from collar 249 and perpendicularly to axis 22 through L-shaped aperture 294 of housing 266 just as in the first embodiment, except that L-shaped aperture 294 is now located closer to the second end 286 of housing 266 than in the first embodiment.

Furthermore, one end of spring 208 engages the first end 284 of housing 266, and the other end of spring 208 engages the first side 251 of collar 249. Thus, the need for a second spring, such as spring 109 in the first embodiment, is eliminated, and housing 266 is shorter in length than housing 166.

In operation, spring 208 biases wedge ratchet members 204 and 206 together, as discussed above with respect to the first embodiment. Spring 208 also biases threaded pin 250 into the second leg 298 of L-shaped aperture 294 when engaging bar 272 forces threaded pin 250 out of the top leg (not shown) of L-shaped aperture 294 as first support 214 is forced into the closed position. Accordingly, spring 208 biases collar 249 and thus, pivot pin 226 in the downward vertical direction 219, thereby engaging wedge ratchet members 204 and 206.

THIRD EMBODIMENT OF FIG. 12

Figure 12:
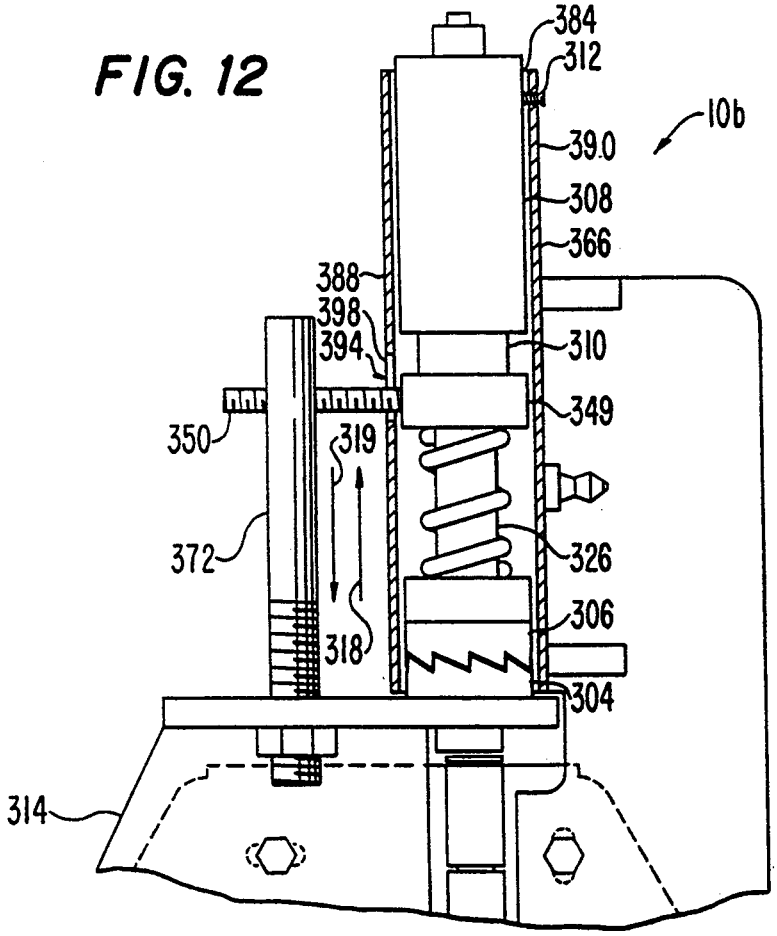
FIG. 12 is a partial front elevational view of a third embodiment of a locking device in accordance with this invention, having the housing broken away for clarity.

A third embodiment, locking device 10*b*, is illustrated in FIG. 12. This third embodiment is similar to the previous embodiments in many respects and thus, only the differences from the previous embodiments will be discussed.

Whereas wedge ratchet members 104 and 106 in the first embodiment of the locking device 10 are disengaged manually, wedge ratchet members 304 and 306 are disengaged either automatically through the use of solenoid 308 or manually. Solenoids such as solenoid 308 are common and well-known and thus, solenoid 308 will not be described in detail herein.

Generally, solenoid 308 has rod or piston 310 and extends axially within housing 366 from the first end 384 of housing 366. Solenoid 308 is fixedly coupled within housing 366 by set screw 312 extending perpendicularly through second side 390 adjacent first end 384 of housing 366. When solenoid 308 is activated or energized, it produces a magnetic field causing piston 310 to move axially in the upward vertical direction 318 into the core of solenoid 308.

Piston 310 is fixedly coupled to collar 349 in bore (not shown) of collar 349. Like in the first embodiment, collar 349 is fixedly coupled to pivot pin 326 and has threaded pin 350 extending perpendicularly and outwardly from collar 349 through L-shaped aperture 394 in first side 388 of the housing 366. Furthermore, second wedge ratchet member 306 is movably coupled to pivot pin 326, as previously discussed with respect to the first embodiment. Thus, when the magnetic field produced by solenoid 308 causes piston 310 to move axially into the core of solenoid 308, collar 349, pivot pin 326 and second wedge ratchet member 306 are also forced upwardly in the upward vertical direction 318 which disengages wedge ratchet members 304 and 306.

When solenoid 308 is deactivated and thus is no longer producing a magnetic field, piston 310 moves axially in the downward vertical direction 319 forcing collar 349, pivot pin 326 and second wedge ratchet member 306 in the downward vertical direction 319 until wedge ratchet members 304 and 306 are engaged again.

Threaded pin 350 may function as a manual override. If solenoid 308 malfunctions or if it is preferable to manually disengage wedge ratchet members 304 and 306, then threaded pin 350 can be manually forced in the upward vertical direction 318 and pivoted onto second leg 398 of L-shaped aperture 394, which acts as a shelf and maintains wedge ratchet members 304 and 306 in a disengaged position, as previously discussed.

Finally, as with the prior embodiments, when door 35 and support member 14 are being returned to closed position 24, just before first support 314 reaches the closed position, engaging bolt 372 engages threaded pin 350 and forces it from the top leg (not shown) of L-shaped aperture 394 into the second leg 398. Threaded pin 350, collar 349 and pivot pin 326 then move in the downward vertical direction 319 until wedge ratchet members 304 and 306 are in engagement.

FOURTH EMBODIMENT OF FIGS. 13–15

Figure 13:
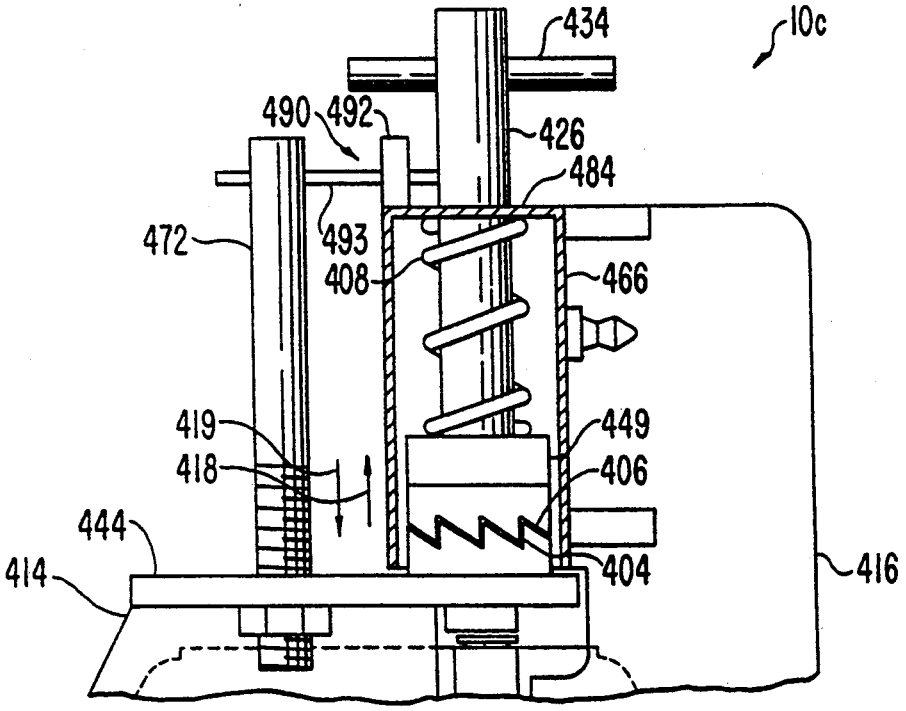
FIG. 13 is a partial front elevational view of a fourth embodiment of a locking device in accordance with this invention, having the housing broken away for clarity.
Figure 14:
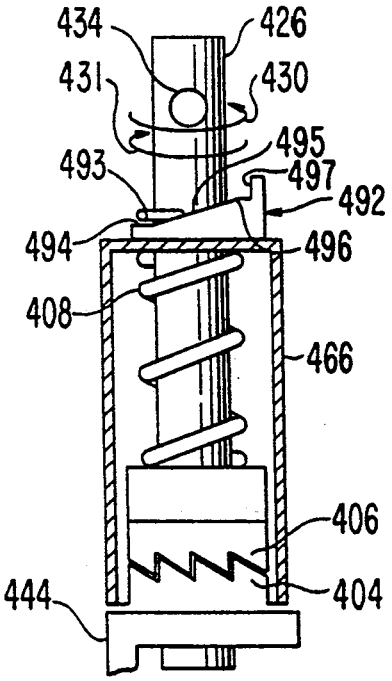
FIG. 14 is a partial side elevational view of the locking device shown in FIG. 13, having the engaging bar removed for clarity.
Figure 15:
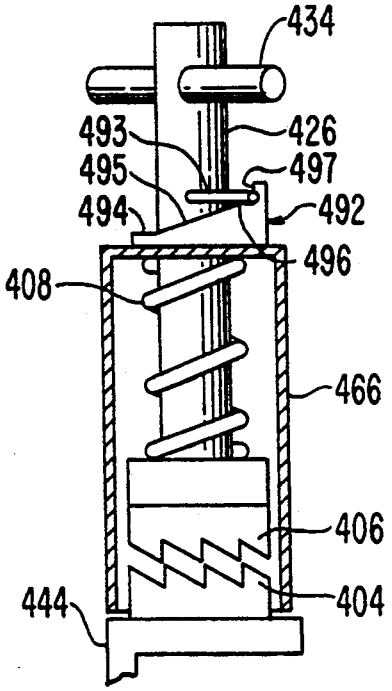
FIG. 15 is a partial side elevational view of the locking device shown in FIGS. 13 and 14, having the engaging bar removed for clarity and showing the wedge ratchet members disengaged.

A fourth embodiment, locking device 10*c*, is illustrated in FIGS. 13–15. This embodiment is similar to the previous embodiments in many respects and thus, only the differences from the previous embodiments will be discussed.

Unlike the previously discussed embodiments, first and second wedge ratchet members 404 and 406 are disengaged through the use of a manual cam release assembly 490, which eliminates the need to apply a force in the upward vertical direction 418 to pivot pin 426. Instead, wedge ratchet members 404 and 406 disengage when a force in the first pivotal direction 430 is applied to handle 434. Stated differently, to disengage wedge ratchet members 404 and 406, handle 434 is rotated in direction 430 and need not also be pulled upward, as in the previous embodiments.

Specifically, cam release assembly 490 includes cam saddle 492 and cam pin 493. Saddle 492 has, in seriatum, first flat portion or surface 494, second angled portion or surface 495, third flat portion or surface 496 and fourth abutment surface 497 and is fixedly coupled to and extends upwardly and outwardly from first end 484 of housing 466. Flat surfaces 494 and 496 are parallel to first end 484 of housing, and angled surface 495 extends upwardly and angularly from first flat surface 494 to third flat surface 496. Abutment surface 497 extends upwardly and perpendicularly from third flat surface 496 and acts as a stop for cam pin 493.

Cam pin 493 is preferably cylindrical, is fixedly coupled to pivot pin 426 for movement with pivot pin 426 and extends outwardly and perpendicularly from pivot pin 426 above first end 484 of housing 466. Cam pin 493 rests on or engages first flat surface 494 when wedge ratchet members 404 and 406 are engaged, as in FIG. 14. Cam pin 493 rests on third flat surface 496 and abuts abutment surface 497 when wedge ratchet members 404 and 406 are disengaged, as in FIG. 15.

In operation, handle 434 is rotated in the first pivotal direction 430 which moves pivot pin 426 upwardly in direction 418 as cam pin 493 move upwardly along angled surface 495 and simultaneously pivots pivot pin 426 and cam pin 493 in the first pivotal direction 430. Specifically, as cam pin 493 pivots, it slides from first flat surface 494 upwardly and angularly along second angled surface 495 until it reaches third flat surface 496. Abutment surface 497 acts as a stop and keeps cam pin 493 on flat surface 496. The movement of cam pin 493 upwardly along angled surface 495 forces pivot pin 426 in the upward vertical direction 418, which, in turn, disengages wedge ratchet members 404 and 406. Furthermore, wedge ratchet members 404 and 406 remain disengaged until first support 414 is pivoted and forced into the closed position when engaging bar 472 engages cam 493, which pivots cam pin 493 in the second pivotal direction 431 from the third flat surface 496 back to first flat surface 494. This, of course, engages wedge ratchet members 404 and 406 again as spring 408 biases against collar 449 at one end and against first end 484 of housing 466 at the other end, which forces pivot pin 426 in the second vertical direction 419 until wedge ratchet member 406 engages wedge ratchet member 404, as in FIG. 13.

FIFTH EMBODIMENT OF FIGS. 16–18

Figure 16:
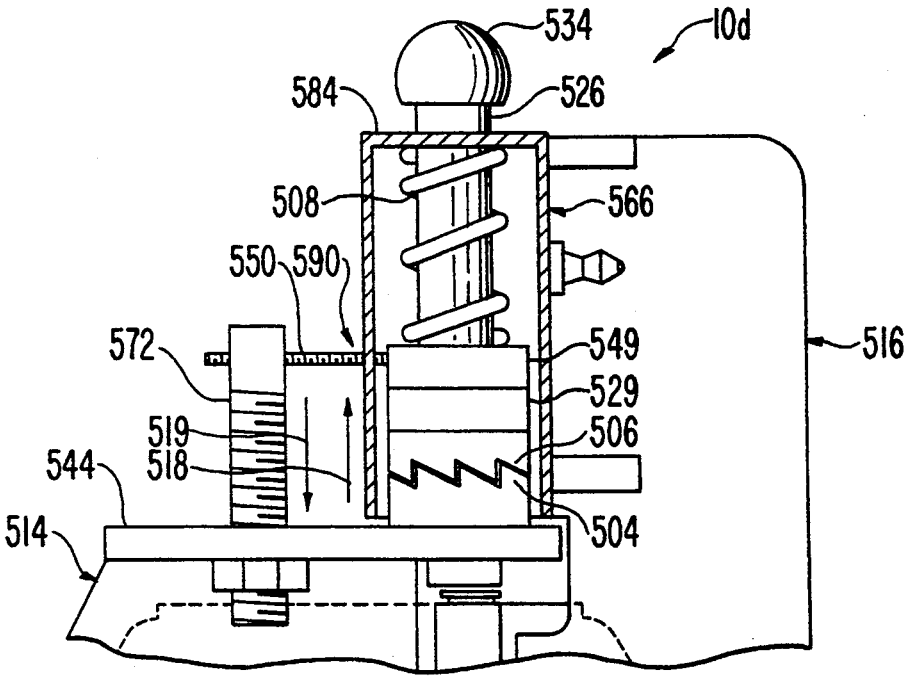
FIG. 16 is a partial front elevational view of a fifth embodiment of a locking device in accordance with this invention, having the housing broken away for clarity.
Figure 17:
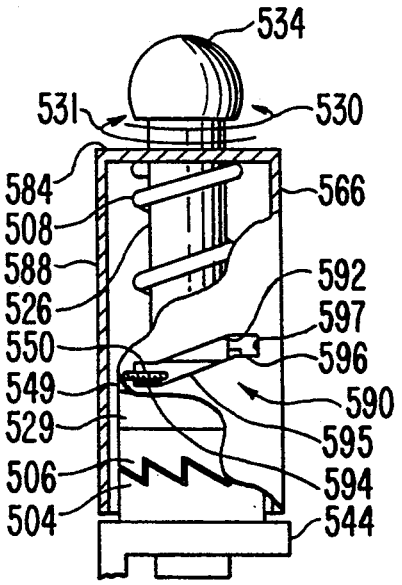
FIG. 17 is a partial side elevational view of the locking device shown in FIG. 16, having the engaging bar removed for clarity.
Figure 18:
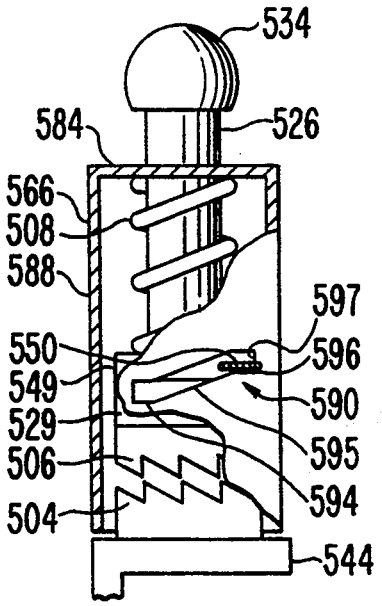
FIG. 18 is a partial side elevational view of the locking device shown in FIGS. 16 and 17, having the engaging bar removed for clarity and showing the wedge ratchet members disengaged.

A fifth embodiment, locking device **10*d*, is illustrated in FIGS. 16–18**. This embodiment is very similar to the second and fourth embodiments and thus, only the differences with these embodiments will be discussed.

Like the wedge ratchet members 404 and 406 of the fourth embodiment, wedge ratchet members 504 and 506 are disengaged through the use of a manual cam release assembly 590, which disengages wedge ratchet members 504 and 506 when a force in the first pivotal direction 530 is applied to handle 534. Cam release assembly 590 is formed in housing 566 similar to the second embodiment, and pivot pin 526 is shorter.

Specifically, cam release assembly 590 includes a cam aperture 592 in housing 566 and a threaded pin 550. Cam aperture 592 has, in seriatum, a first flat surface 594, a second sloping surface 595, a third flat surface 596, and a fourth abutment surface 597 and is formed in the first side 588 of housing 566. Threaded cam pin 550 is preferably cylindrical and is fixedly coupled to collar 549, which is movably coupled to pivot pin 526. Collar 549 rotatably abuts collar 529. Threaded cam pin 550 extends outwardly from collar 549 perpendicular to pivot pin 526 through cam aperture 592. Threaded cam pin 550 rests on or engages first flat surface 594 when wedge ratchet members 504 and 506 are engaged, as in FIG. 17. Threaded cam pin 550 rests on third flat surface 596 and abuts abutment surface 597 when wedge ratchet members 504 and 506 are disengaged, as in FIG. 18.

In operation, handle 534 is rotated in the first pivotal direction 530, which, of course, simultaneously pivots pivot pin 526, collar 549, collar 529 and threaded cam pin 550 in the same direction. As threaded cam pin 550 pivots, it slides from the first flat surface 594 upwardly and angularly along the second sloping surface 595 until it reaches the third flat surface 596 and engages abutment surface 597, which limits any further pivotal movement and helps hold threaded cam pin 550 on third flat surface 596. As threaded cam pin 550 slides upwardly along second sloping surface 595, it forces collar 549, pivot pin 526, and wedge ratchet member 506 in the upward vertical direction 518. When threaded cam pin 550 reaches third flat surface 596, wedge ratchet member 504 and 506 are disengaged. Furthermore, because cam pin 550 rests on third flat surface 596, wedge ratchet members 504 and 506 are maintained in the disengaged position until cam pin 550 is forced off of third flat surface 596 by engaging bolt 572, which occurs when first support 514 pivots into the closed position, as in FIG. 17, and as discussed with respect to the fourth embodiment.

Alternatively, instead of rotating handle 534 to disengage wedge ratchet members 504 and 506, threaded cam pin 550 can be manually slid along surfaces 594–596 until threaded cam pin 550 rests on third flat surface 596 against abutment surface 597 and wedge ratchet members 504 and 506 are disengaged. Furthermore, although not shown, cam aperture 592 may be formed in each side of housing 566 with threaded coupling pins 550 extending through each aperture from collar 549. This may make disengaging wedge ratchet members 504 and 506 easier as threaded cam pins 550 would be manually slidable from any direction.

SIXTH EMBODIMENT OF FIGS. 19 AND 20

Figure 19:
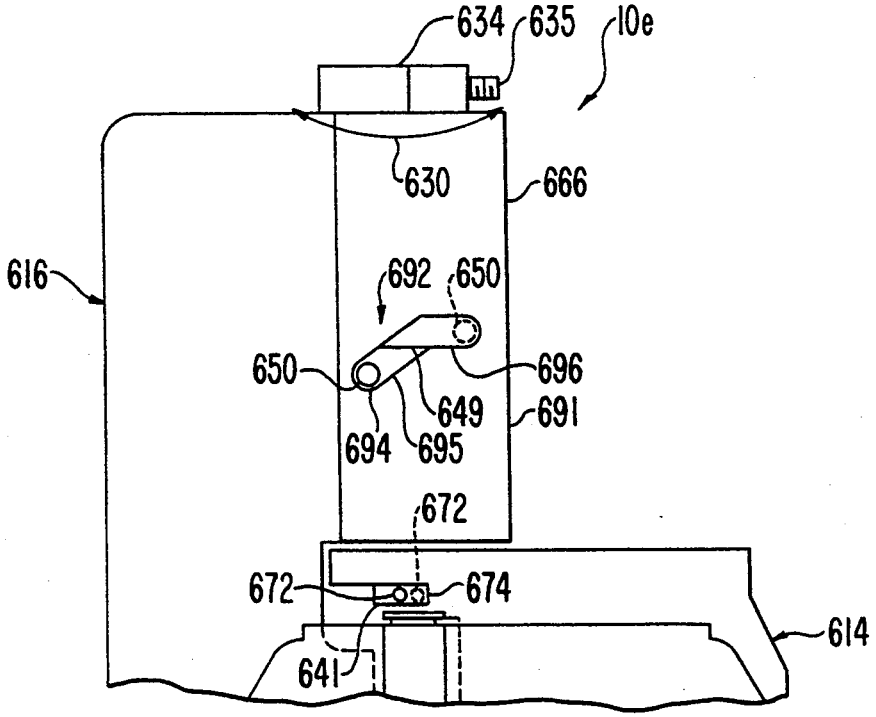
FIG. 19 is a partial back elevational view of a sixth embodiment of a locking device in accordance with this invention.
Figure 20:
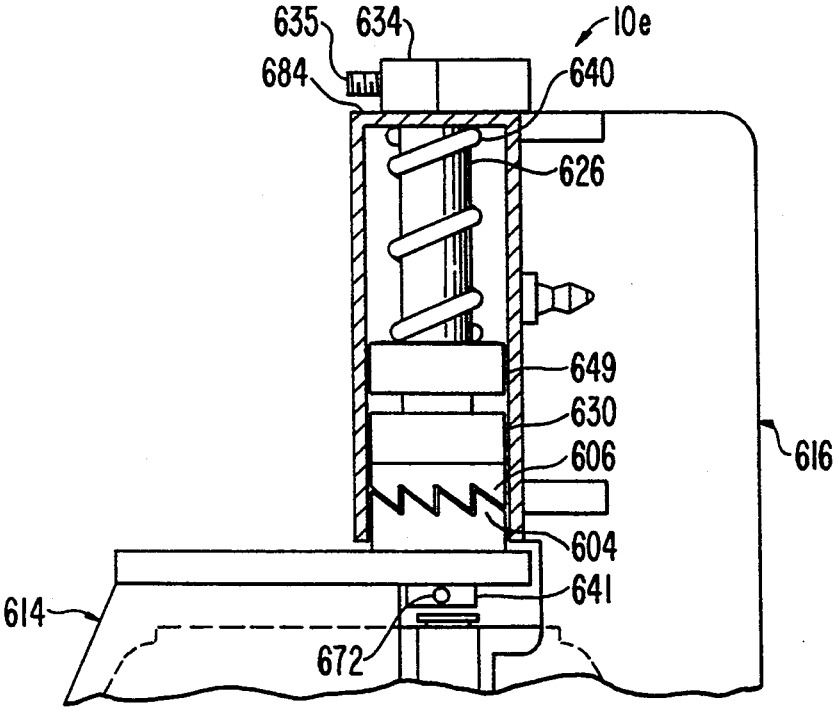
FIG. 20 is a partial front elevational view of the locking device shown in FIG. 19, having the housing broken away for clarity.

A sixth embodiment, locking device **10*e*, is illustrated in FIGS. 19 and 20**. This embodiment is very similar to the fifth embodiment and thus, only the differences from the fifth embodiment will be discussed.

Collar 649 is slightly spaced apart from collar 630 and has threaded cam pin 650 extending perpendicularly and outwardly through the back side 691 of housing 666. Cam pin 650 is relatively short and flush with the outer edge of the back side 691.

Back side 691 has cam aperture 692 therethrough. Cam aperture 692 includes, in seriatum, first flat surface 694, second sloping surface 695 and third flat surface 696. Sloping surface 695 extends angularly between flat surfaces 694 and 696.

Pivot pin 626 has a second threaded pin 672 extending perpendicularly to and outwardly from second end 641 of pivot pin 626. Pivot pin 626 also has a handle 634 fixedly coupled at its first end 640 by threaded pin 635. Handle 634 rotatably rests on top of the first end of housing 684.

This embodiment operates very similarly to the fifth embodiment. When locking device 10*e* is to be deactivated or pivoted from an open position to the closed position, as previously discussed, handle 634 is pivoted in the first pivotal direction 630 which in turn forces threaded cam pin 650 from its first flat surface 694 along angled surface 695 until it reaches second flat surface 696, as illustrated in FIG. 19 by pin 650 represented by a dotted line. This disengages wedge ratchet members 604 and 606, as previously discussed and shown with respect to previous embodiments, so that first support member 614 can be pivoted back into the first closed position. Upon reaching the closed position, threaded pin 672 engages surface 674 of first support member 614, as illustrated in FIG. 19 by pin 672 represented by a dotted line, which in turn forces threaded cam pin 650 from second flat surface 696 to first flat surface 694, thereby reengaging wedge ratchet members 604 and 606.

Various modifications, improvements and other embodiments will become apparent to those skilled in the art once given this disclosure. Such modifications, improvements and other embodiments are considered to be within the scope of this invention as defined by the following claims.

What is claimed is:

1. A locking device for pivotally connecting a closure to a support and locking the closure in an open position relative to the support, wherein the closure pivots about an axis between a closed position and at least one open position, said locking device comprising:

a locking means having a first ratchet member fixedly coupled to the closure, a second ratchet member coupled to the support and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement;

a releasing means for disengaging said first and second ratchet members without further rotation of either said first or second ratchet members, thereby allowing the closure to pivot in a second direction to a closed position, said releasing means including:

a pivot pin coupled to the closure and extending along said axis, said second ratchet member being movably coupled to said pivot pin for movement with said pivot pin in a third direction, thereby disengaging said second ratchet member from said first ratchet member when said pivot pin is moved in said third direction; and a pin assembly for holding said first and second ratchet members in the disengaged position, thereby allowing the closure to pivot to said closed position, said pin assembly including a second pin coupled to said pivot pin and extending perpendicularly to said axis; and a housing containing at least a portion of said locking means and said releasing means, said housing including an aperture through which said second pin extends and forming a shelf on which said second pin rests when said first and second ratchet members are disengaged.

2. A locking device for pivotally connecting a closure to a support as in claim 1, wherein said biasing means includes a spring for biasing said second ratchet member into engagement with said first ratchet member.

3. A locking device for pivotally connecting a closure to a support as in claim 1 further comprising an engaging means for engaging said first and second ratchet members when the closure pivots into said closed position, said engaging means including a fourth pin extending parallel to said axis upwardly from the support for engaging said second pin and forcing it off of said shelf.

4. A locking device for pivotally connecting a closure to a support as in claim 1, wherein said teeth have a third flat surface for preventing wear and breakage of said first and second ratchet members.

5. A locking device for holding a closure in at least one open position relative to a support, comprising:

a first member fixedly coupled to the closure for movement therewith;

a second member fixedly coupled to the support; and an interlocking means for interconnecting said second member to said first member about an axis and for pivoting said first member about said axis to open and close the closure relative to the support, including a locking means having a first ratchet member fixedly coupled to said first member, a second ratchet member coupled to said second member and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement, and a releasing means for disengaging said first and second ratchet members without further rotation of either said first or second ratchet members coupled to either of said first or second members, thereby allowing said first member to pivot in a second direction to a closed position and close the closure, said releasing means including:

a pivot pin coupled to said second member and extending along said axis, said second ratchet member being movably coupled to said pivot pin for movement with said pivot pin in a third direction, thereby disengaging said second ratchet member from said first ratchet member when said pivot pin is moved in said third direction; and a solenoid which moves said pivot pin in said third direction to disengage said first and second ratchet members when said solenoid is activated, thereby allowing said first member to pivot in said second direction from said open position to said closed position and close the closure;

wherein said first member pivots about said axis between said closed position and at least one open position.

6. A locking device for holding a closure in at least one open position relative to a support as in claim 5, wherein said biasing means includes a spring for biasing said second ratchet member into engagement with said first ratchet member.

7. A locking device for holding a closure in at least one open position relative to a support as in claim 5, wherein said first member is fixedly coupled to the closure by a first hinge leaf, and said second member is fixedly coupled to the support by a second hinge leaf.

8. A locking device for holding a closure in at least one open position relative to a support as in claim 5, wherein said solenoid includes a rod fixedly coupled to said pivot pin, said rod being forced in said third direction when said solenoid is activated, thereby disengaging said first and second ratchet members.

9. A locking device for holding a closure in at least one open position relative to a support as in claim 8, wherein said solenoid is fixedly coupled to said second member by a set screw.

10. A locking device for pivotally connecting a closure to a support and locking the closure in an open position relative to the support, comprising:

a locking means having a first ratchet member fixedly coupled to the closure, a second ratchet member coupled to the support and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement; and a releasing means for disengaging said first and second ratchet members without further rotation of either said first or second ratchet members, thereby allowing the closure to pivot in a second direction to a closed position;

wherein the closure pivots about an axis between said closed position and at least one open position;

said releasing means including a pivot pin coupled to the closure and extending along said axis, said second ratchet member being movably coupled to said pivot pin for movement with said pivot pin in a third direction, thereby disengaging said second ratchet member from said first ratchet member when said pivot pin is moved in said third direction; and a solenoid which moves said pivot pin in said third direction to disengage said first and second ratchet members when said solenoid is activated, thereby allowing the closure to pivot in said second direction from said open position to said closed position.

11. A locking device for pivotally connecting a closure to a support and locking the closure in an open position relative to the support, wherein the closure pivots about an axis between a closed position and at least one open position, said locking device comprising:

a locking means having a first ratchet member fixedly coupled to the closure, a second ratchet member coupled to the support and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement;

a releasing means for disengaging said first and second ratchet members without further rotation of either said first or second ratchet members coupled to either the closure or the support, thereby allowing the closure to pivot in a second direction to a closed position; said releasing means including:

a pivot pin coupled to the closure and extending along said axis, said second ratchet member being movably coupled to said pivot pin for movement with said pivot pin in a third direction, thereby disengaging said second ratchet member from said first ratchet member when said pivot pin is moved in said third direction; and a cam assembly having a cam pin and a cam surface, said cam surface including a first flat portion, a second angled portion and a third flat portion, said cam pin being movable in said first and second directions, being fixedly coupled to said pivot pin, engaging said first surface when said first and second ratchet members are engaged and engaging said third surface when said first and second ratchet-members are disengaged; and a housing containing at least a portion of said locking means and said releasing means, said cam surface being formed by said housing.

12. A locking device for pivotally connecting a closure to a support and locking the closure in a set position relative to the support, comprising:

a locking means having a first ratchet member fixedly coupled to the closure, a second ratchet member coupled to the support and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement; and a releasing means for disengaging said first and second ratchet members without further rotation of either said first or second ratchet members coupled to either the closure or the support, thereby allowing the closure to pivot in a second direction to a closed position;

wherein the closure pivots about an axis between said closed position and at least one open position;

said releasing means includes a pivot pin coupled to the closure and extending along said axis, said second ratchet member being movably coupled to said pivot pin for movement with said pivot pin in a third direction, thereby disengaging said second ratchet member from said first ratchet member when said pivot pin is moved in said third direction;

said pivot pin includes, in seriatim, a first portion, a second reduced portion and a third portion, said second ratchet member being movably coupled to said pivot pin at said second reduced portion for movement along said second reduced portion in said third direction and in a fourth direction when the closure pivots in said second direction to said closed position and when said biasing means biases said second ratchet member into engagement with said first ratchet member.

13. A locking device for holding a closure in at least one open position relative to a support, comprising:

a first member fixedly coupled to the closure for movement therewith;

a second member fixedly coupled to the support; and an interlocking means for interconnecting said second member to said first member about an axis and for pivoting said first member about said axis to open and close the closure relative to the support, including a locking means having a first ratchet member fixedly coupled to said first member, a second ratchet member coupled to said second member and a biasing means for biasing said first and second ratchet members into engagement with each other, each of said first and second ratchet members having compatible teeth having a first ramping surface and a second stopping surface for limiting pivotal movement between said first and second sets of ratchet members to a first direction and locking the closure in a set position when said first and second ratchet members are in engagement, and a releasing means for disengaging said first and second ratchet members without further rotation of either said first or second ratchet members coupled to either of said first or second members, thereby allowing said first member to pivot in a second direction to a closed position and close the closure, said releasing means including:

a pivot pin coupled to said second member and extending along said axis, said second ratchet member being movably coupled to said pivot pin for movement with said pivot pin in a third direction, thereby disengaging said second ratchet member from said first ratchet member when said pivot pin is moved in said third direction; and a cam assembly having a cam pin and a cam surface, said cam surface being coupled to said second member and including a first flat portion, a second angled portion and a third flat portion, said cam pin being movable in said first and second directions, fixedly coupled to said pivot pin and engaging said first surface when said first and second ratchet members are engaged and engaging said third surface when said first and second ratchet members are disengaged;

wherein said first member pivots about said axis between said closed position and at least one open position.

14. A locking device for holding a closure in at least one open position relative to a support as in claim 13, wherein said cam surface extends upwardly from said second member.

15. A locking device for holding a closure in at least one open position relative to a support as in claim 13, wherein said cam surface is formed by an aperture extending through said second member.

16. A locking device for holding a closure in at least one open position relative to a support, comprising:

a first member fixedly coupled to the closure for movement therewith;

a second member fixedly coupled to the support; and an interlocking means for interconnecting said second member to said first member about an axis and for pivoting said first member about said axis to open and close the closure relative to the support, including a locking means having a first ratchet member fixedly coupled to said first member, a second ratchet member coupled to said second member and a biasing means for biasing said first and second ratchet members into engagement with each other, each of said first and second ratchet members having compatible teeth having a first ramping surface and a second stopping surface for limiting pivotal movement between said first and second ratchet members to a first direction and locking the closure in a set position when said first and second ratchet members are in engagement, and a releasing means for disengaging said first and second ratchet members without further rotation of either said first or second ratchet members coupled to either of said first or second members, thereby allowing said first member to pivot in a second direction to a closed position and close the closure, said releasing member including:

a pivot pin coupled to said second member and extending along said axis, said second ratchet member being movably coupled to said pivot pin for movement with said pivot pin in a third direction, thereby disengaging said second ratchet member from said first ratchet member when said pivot pin is moved in said third direction; and a pin assembly for holding said first and second ratchet members in a disengaged position, thereby allowing said first member to pivot to said closed position;

said pin assembly includes a second pin coupled to said pivot pin and extending perpendicularly to said axis and an aperture formed in said second member through which said second pin extends and forming a shelf on which said second pin rests when said first and second ratchet members are disengaged;

wherein said first member pivots about said axis between said closed position and at least one open position.

17. A locking device for holding a closure in at least one open position relative to a support as in claim 16, wherein said pivot pin includes, in seriatum, a first portion, a second reduced portion and a third portion, said second ratchet member being movably coupled to said pivot pin at said second reduced portion for movement along said second reduced portion in said third direction and in a fourth direction when said first member pivots in said first direction to said open position and when said biasing means biases said second ratchet member into engagement with said first ratchet member.

18. A locking device for holding a closure in at least one open position relative to a support as in claim 17, wherein said second ratchet member is movably coupled to said reduced portion by a collar rigidly coupled to said second ratchet member having a third pin extending through said collar perpendicularly to said axis and abutting said reduced portion.

19. A locking device for holding a closure in at least one open position relative to a support as in claim 17, wherein said first member pivots about said axis between said closed position and four open positions.

20. A locking device for holding a closure in at least one open position relative to a support as in claim 19, wherein each position is spaced 36° from the next adjacent position.

21. A locking device for holding a closure in at least one open position relative to a support as in claim 19, wherein said teeth have a third flat surface for preventing wear and breakage of said ratchet members.

22. A locking device for holding a closure in at least one open position relative to a support as in claim 21, wherein said first and second ratchet members are formed of metal.

23. A locking device for holding a closure in at least one open position relative to a support as in claim 19, wherein said releasing means includes a handle removably and fixedly coupled to said pivot pin at said first portion for applying a force in said third direction and in said second direction to said pivot pin, thereby engaging said second pin with said shelf, disengaging said first and second ratchet members and allowing the closure to pivot in said second direction from one of said open positions to said closed position.

24. A locking device for holding a closure in at least one open position relative to a support as in claim 19 further comprising an engaging means for engaging said first and second ratchet members when said first member pivots into said closed position.

25. A locking device for holding a closure in at least one open position relative to a support as in claim 24, wherein said engaging means includes a fourth pin extending parallel to said axis upwardly from said first member for engaging said second pin and forcing it off of said shelf, thereby engaging said first and second ratchet members.

26. A locking device for holding a closure in at least one open position relative to a support as in claim 25, wherein said engaging means includes a second spring engaging said first collar and biasing said first collar and said pivot pin in said fourth direction when said second pin and said shelf are disengaged, thereby engaging said first and second ratchet members.

27. A locking device for holding a closure in at least one open position relative to a support as in claim 24, wherein said first and second members include a plurality of fastening assemblies for coupling said first member to the closure and said second member to the support.

28. A locking device for holding a closure in at least one open position relative to a support as in claim 27, wherein said first member includes a flange and base member, said flange being fixedly coupled to said base member and extending perpendicularly and outwardly therefrom.

29. A locking device for holding a closure in at least one open position relative to a support as in claim 28, wherein said flange forms a stop surface for limiting the pivotal movement of said first member in said first direction.

30. A locking device for holding a closure in at least one open position relative to a support as in claim 28, wherein said first ratchet member is fixedly coupled to said flange.

31. A locking device for holding a closure in at least one open position relative to a support as in claim 27, wherein said second member includes a housing and a base member, said housing being fixedly coupled to said base member and enclosing said first and second ratchet members.

* * * * *